US011396785B2

(12) United States Patent
Mukhlifi

(10) Patent No.: US 11,396,785 B2
(45) Date of Patent: Jul. 26, 2022

(54) LOW PRESSURE STARTER WELLHEAD SYSTEM FOR OIL AND GAS APPLICATIONS WITH POTENTIAL THERMAL GROWTH

(71) Applicant: Saudi Arabian Oil Company, Dhahran (SA)

(72) Inventor: Mohammed E. Mukhlifi, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/871,800

(22) Filed: May 11, 2020

(65) Prior Publication Data

US 2021/0348468 A1 Nov. 11, 2021

(51) Int. Cl.

| | |
|---|---|
| ***E21B 33/04*** | (2006.01) |
| ***E21B 33/068*** | (2006.01) |
| ***E21B 17/01*** | (2006.01) |
| ***E21B 33/03*** | (2006.01) |
| ***E21B 34/16*** | (2006.01) |
| ***E21B 33/06*** | (2006.01) |
| ***E21B 33/12*** | (2006.01) |
| ***E21B 44/04*** | (2006.01) |
| ***E21B 21/08*** | (2006.01) |

(52) U.S. Cl.

CPC ..... *E21B 33/04* (2013.01); *E21B 33/068* (2013.01); *E21B 17/01* (2013.01); *E21B 21/08* (2013.01); *E21B 33/03* (2013.01); *E21B 33/06* (2013.01); *E21B 33/12* (2013.01); *E21B 34/16* (2013.01); *E21B 44/04* (2013.01)

(58) Field of Classification Search

CPC ..... E21B 33/04; E21B 33/068; E21B 33/06; E21B 33/12; E21B 33/03

See application file for complete search history.

(56) References Cited

U.S. PATENT DOCUMENTS

| | | | | |
|---|---|---|---|---|
| 4,541,490 | A | 9/1985 | Bigbie et al. | |
| 4,652,022 | A * | 3/1987 | Nichols | E21B 33/04 285/393 |
| 4,886,121 | A * | 12/1989 | Demny | E21B 17/1007 166/382 |
| 5,076,356 | A | 12/1991 | Reimert | |
| 5,464,063 | A | 11/1995 | Boehm | |
| 6,571,877 | B1 * | 6/2003 | Van Bilderbeek | E21B 33/03 166/339 |

(Continued)

FOREIGN PATENT DOCUMENTS

| | | |
|---|---|---|
| EP | 0523301 | 1/1993 |

OTHER PUBLICATIONS

PCT International Search Report and Written Opinion in International Appln. No. PCT/US2021/031717, dated Aug. 2, 2021, 14 pages.

*Primary Examiner* — Taras P Bemko

(74) *Attorney, Agent, or Firm* — Fish & Richardson P.C.

(57) ABSTRACT

A wellhead system includes a housing defining an axial bore, an outer pipe secured to the housing and extending axially from the housing, an inner pipe passing through the axial bore and through the outer pipe and having an outer diameter that is smaller than an inner diameter of the outer pipe, and a sealing device positioned along an inner surface of the housing and sealed to the inner pipe to seal an annular region defined between the inner and outer pipes.

16 Claims, 8 Drawing Sheets

(56) References Cited

U.S. PATENT DOCUMENTS

| | | | | |
|---|---|---|---|---|
| 7,836,973 | B2 | 11/2010 | Belcher et al. | |
| 9,574,404 | B2 | 2/2017 | Tunget | |
| 9,732,596 | B2 | 8/2017 | Ollier et al. | |
| 9,835,009 | B2 | 12/2017 | Hess et al. | |
| 10,487,587 | B2 | 11/2019 | Cummins | |
| 2007/0044957 | A1 | 3/2007 | Watson et al. | |
| 2008/0017386 | A1* | 1/2008 | Van Bilderbeek | E21B 33/03 166/373 |
| 2009/0107685 | A1* | 4/2009 | Cain | E21B 33/04 166/379 |
| 2010/0126736 | A1 | 5/2010 | Ellis et al. | |
| 2011/0011599 | A1* | 1/2011 | Nguyen | E21B 33/00 166/386 |
| 2013/0014947 | A1* | 1/2013 | Wilkins | E21B 33/068 166/281 |
| 2014/0345850 | A1 | 11/2014 | Galle et al. | |
| 2015/0376970 | A1* | 12/2015 | Hughes | E21B 33/03 166/84.1 |
| 2016/0069149 | A1 | 3/2016 | Borak et al. | |

* cited by examiner

LOW PRESSURE STARTER WELLHEAD SYSTEM FOR OIL AND GAS APPLICATIONS WITH POTENTIAL THERMAL GROWTH

TECHNICAL FIELD

This disclosure relates to low pressure starter wellhead systems capable of accommodating thermal expansion and related methods of installing such a wellhead system at a pipe assembly within a wellbore.

BACKGROUND

Drilling activities performed at a well within a surface formation can sometimes cause the surface formation to detrimentally leak fluids to the environment through tubing assemblies installed in the well. A starter wellhead may be installed to a casing assembly at the surface of the well. However, such wellheads are prone to failure with respect to sealing a surface formation to prevent fluid leakage and cannot accommodate thermal expansion of the tubing assembly.

SUMMARY

This disclosure relates to a low pressure starter wellhead system for casings of first and second sizes and a method of installing the wellhead system at a pipe assembly including such casings. The wellhead system appropriately seals a surrounding surface formation without restricting thermal-related expansion of the first and second casings and is designed to be installed beneath a primary casing. The wellhead system includes a first starter wellhead associated with the first size and a second starter wellhead associated with the second size that are arranged in a vertically stacked configuration.

In one aspect, a wellhead system includes a housing defining an axial bore, an outer pipe secured to the housing and extending axially from the housing, an inner pipe passing through the axial bore and through the outer pipe and having an outer diameter that is smaller than an inner diameter of the outer pipe, and a sealing device positioned along an inner surface of the housing and sealed to the inner pipe to seal an annular region defined between the inner and outer pipes.

Embodiments may provide one or more of the following features.

In some embodiments, the wellhead system further includes a lock ring that secures the sealing device to the inner surface of the housing.

In some embodiments, the sealing device includes an outer interference fit sealing element that seals to the outer pipe.

In some embodiments, the sealing device includes an inner interference fit sealing element that seals to the inner pipe.

In some embodiments, the sealing device is configured to accommodate thermal expansion of the inner pipe while maintaining a seal integrity against the inner pipe.

In some embodiments, the sealing device includes a test port for testing an integrity of the seal.

In some embodiments, the sealing device is configured to be reenergized following a reduction in sealing performance.

In some embodiments, the sealing device includes an injection port for injecting a substance to reenergize the sealing device.

In some embodiments, the outer pipe includes an outer pipe wall and a landing ring that protrudes radially inward from the outer pipe wall.

In some embodiments, the inner pipe includes an inner pipe wall and an abutment ring that protrudes radially outward from the inner pipe wall.

In some embodiments, the inner pipe is configured such that the abutment ring can land on the landing ring, and the outer pipe is configured to support a load of the inner pipe.

In some embodiments, the landing ring is a first landing ring, and the inner pipe includes a second inner landing ring that protrudes radially inward from the inner pipe wall.

In some embodiments, the wellhead system further includes a base plate positioned atop the housing.

In some embodiments, the housing defines an exterior quick connect profile for attachment to an accessory component.

In some embodiments, the wellhead system further includes a valve carried on the housing for relieving a pressure within the annular region.

In some embodiments, the housing is a first housing, the sealing device is a first sealing device, the inner pipe is a first inner pipe, and the wellhead system further includes a second housing positioned above the first housing and secured to the first inner pipe such that the first inner pipe extends axially from the second housing, a second inner pipe passing through an axial bore of the second housing and through the first inner pipe and having an outer diameter that is smaller than an inner diameter of the first inner pipe, and a second sealing device positioned along an inner surface of the second housing and sealed to the second inner pipe to seal a second annular region defined between the first and second inner pipes.

In some embodiments, the second sealing device is configured to accommodate thermal expansion of the second inner pipe while maintaining a seal integrity against the second inner pipe.

In some embodiments, the lock ring is a first lock ring, and the wellhead system further includes a second lock ring that secures the second sealing device to the second housing.

In another aspect, a method of installing a wellhead system at a pipe assembly includes securing an outer pipe to a pipe segment of the pipe assembly, the outer pipe secured to and extending axially from a housing defining an axial bore, landing an outer abutment ring of an inner pipe on an inner landing ring of the outer pipe such that the inner pipe passes through the axial bore of the housing and through the outer pipe, the inner pipe having an outer diameter that is smaller than an inner diameter of the outer pipe, installing a sealing device to an inner surface of the housing, and contacting the sealing device with the inner pipe to seal an annular region defined between the inner and outer pipes.

The details of one or more embodiments are set forth in the accompanying drawings and description. Other features, aspects, and advantages of the embodiments will become apparent from the description, drawings, and claims.

DETAILED DESCRIPTION

Figure 1:
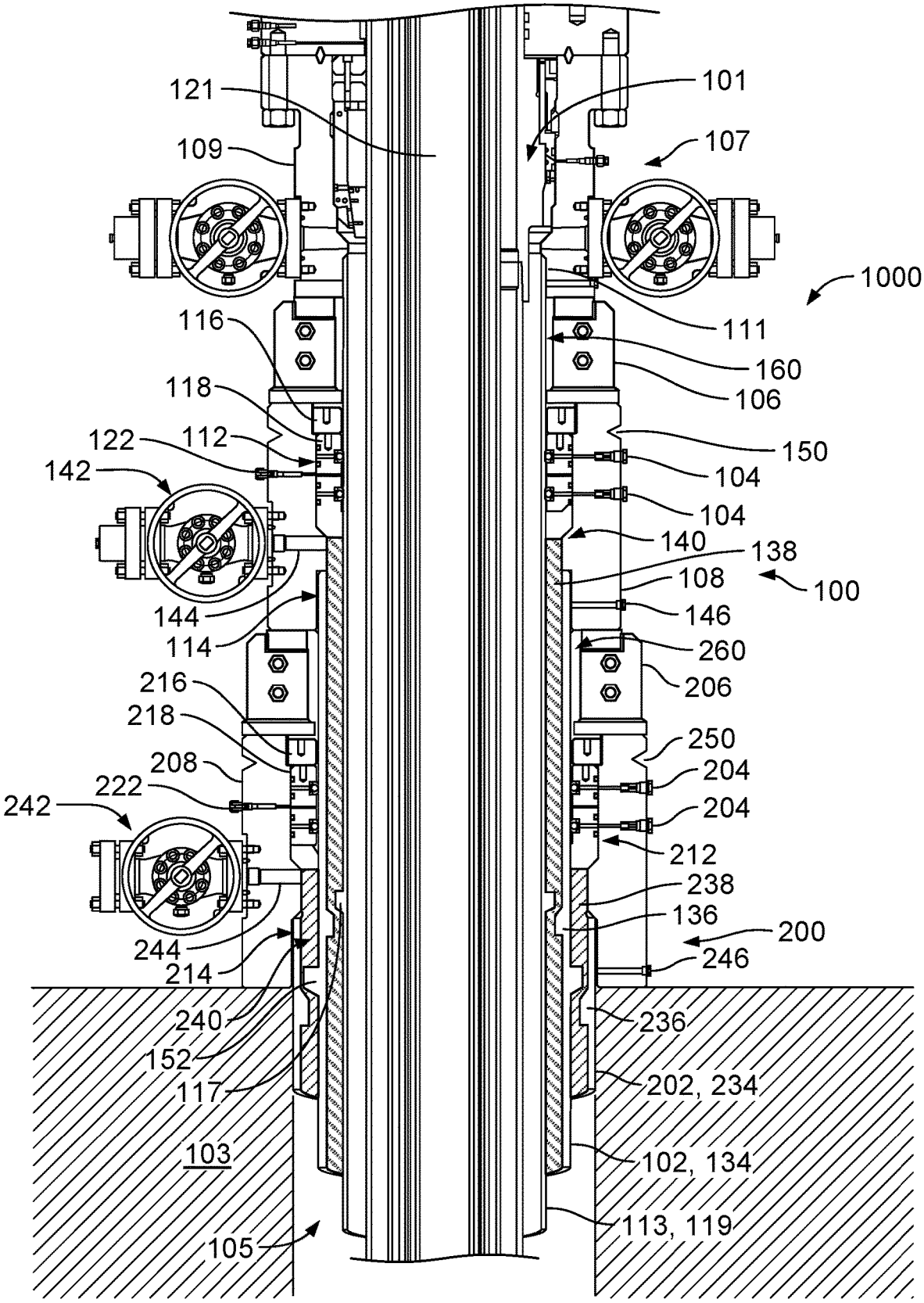
FIG. 1 is a cross-sectional cutaway view of a wellhead system.

FIG. 1 illustrates a wellhead system 1000 installed to a pipe assembly 101 within a wellbore 105 at a surface formation 103. The pipe assembly 101 includes an inner production pipe 121 that produces reservoir fluids from the wellbore 105 and an outer pipe 113 that surrounds the production pipe 121. The wellhead system 1000 is a starter wellhead that provides wellhead sealing integrity for the surface formation 103 in order to prevent the surface formation 103 from releasing fluids through the pipe assembly 101 to the environment during a lifecycle of operations performed at the wellbore 105. The wellhead system 1000 includes a first wellhead assembly 100 of a first size and a second wellhead assembly 200 of a second size that is larger than the first size. The first wellhead assembly 100 is disposed above the second wellhead assembly 200 and is also disposed beneath a reference wellhead assembly 107 (for example, a primary wellhead assembly) of a reference size that is smaller than the first size.

The reference wellhead assembly 107 includes a generally cylindrical housing 109 that defines a recessed profile 111 (for example, an inner, inverted circumferential seat) at which the outer pipe 113 is mated to the housing 109 at a lower end. The reference size of the reference wellhead assembly 107 is defined by an outer diameter of the outer pipe 113 that the recessed profile 111 is sized to securely accommodate. Accordingly, an inner diameter of the recessed profile 111 is sized to securely and snuggly accommodate the outer diameter of the outer pipe 113. In some embodiments, the reference size is about 24 inches (in) (for example, about 0.61 meters (m)). The outer pipe 113 is defined by a cylindrical pipe wall 119 and an outer abutment ring 117 that protrudes radially outward from the pipe wall 119. The outer abutment ring 117 can be landed on a surrounding pipe of the first wellhead assembly 100, as will be discussed in more detail below.

The first wellhead assembly 100 supports the reference wellhead assembly 107 and defines an axial bore 160 that surrounds the outer pipe 113 of the pipe assembly 101. The first wellhead assembly 100 includes a generally cylindrical base plate 106 that is positioned beneath the housing 109 of the reference wellhead assembly 107 and a generally cylindrical housing 108 that is located beneath the base plate 106. An inner diameter of the base plate 106 is about equal to the inner diameter of the recessed profile 111 of the housing 109 such that the outer pipe 113 passes through the base plate 106.

Figure 2:
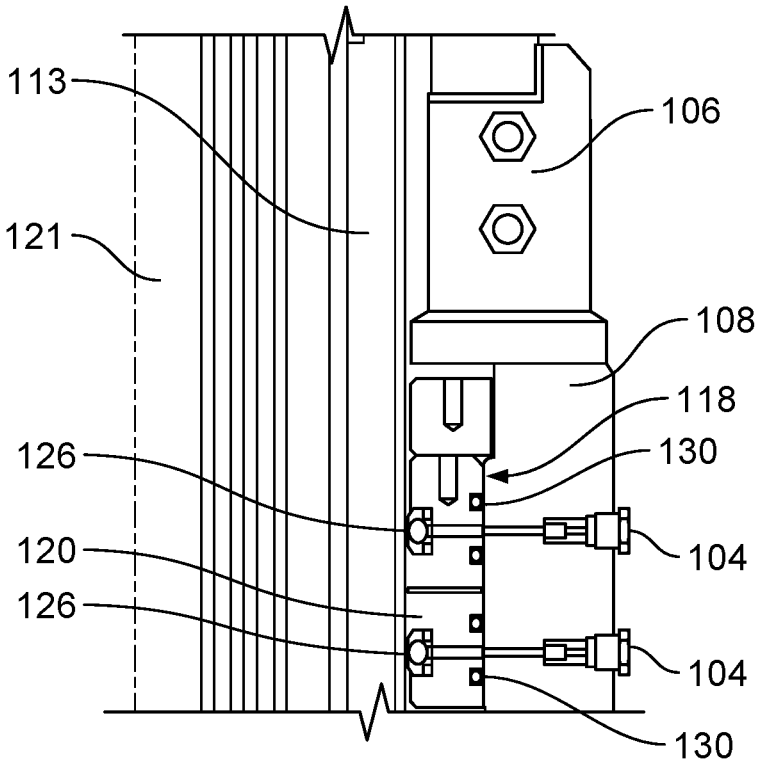
FIG. 2 is an enlarged cross-sectional view of a first set of sealing devices of the wellhead system of FIG. 1.

Referring to FIGS. 1 and 2, the housing 108 defines an upper recessed profile 112 (for example, an inner circumferential seat) and a lower recessed profile 114 (for example, an inner inverted circumferential seat). The housing 108 is equipped with an elastomeric, circumferential sealing device 118 (for example, a packoff) that is seated against the upper recessed profile 112 and a lock ring 116 that secures (for example, locks) the sealing device 118 in place against the upper recessed profile 112. The sealing device 118 and the lock ring 116 have an inner diameter that is about equal to the inner diameter of the base plate 106, thereby allowing passage of and contact with the outer pipe 113 of the pipe assembly 101. The sealing device 118 includes two inner interference fit sealing elements 126 that seal against the outer pipe 113 of the pipe assembly 101, multiple outer interference fit sealing elements 130 that seal against the upper recessed profile 112 of the housing 108, a seal body 120 that supports the sealing elements 126, a test fitting 122 for testing a performance of the sealing device 118, and two injection ports 104. In the event that the sealing device 118 begins to perform poorly, the sealing device 118 can be re-energized to improve the sealing performance by injecting plastic into the injection ports 104.

Sizes and material formulations of the components of the sealing device 118 are selected such that the outer pipe 113 of the pipe assembly 101 can move axially along the first wellhead assembly 100 when thermal expansion of the outer pipe 113 causes such movement without loss of sealing integrity of the sealing device 118. The outer pipe 113 has a precisely machined surface and is made of high grade materials for resisting corrosion during the equipment lifecycle. The interference fit sealing elements 126 are made of one or more materials that can provide the required sealing performance and that can withstand frictional forces exerted by the outer pipe 113 during axial movement (for example, upward and downward movement) of the outer pipe 113 due to thermal expansion. The interference fit sealing elements 126 are typically made of one or materials, such as rubber (for example, hydrogenated acrylonitrile butadiene rubber (HNBR)). The outer interference fit sealing elements 130 and the seal body 120 are typically made of one or materials, such as low alloy steel (LAS).

The first wellhead assembly 100 also includes a first pipe segment 134 that is securely mated (for example, welded) to the lower recessed profile 114. The first size of the first wellhead assembly 100 is defined by an outer diameter of the first pipe segment 134. Accordingly, an inner diameter of the recessed profile 114 is sized to securely and snuggly accommodate the outer diameter of the first pipe segment 134. In some embodiments, the first size is about 30 in (for example, about 0.76 m).

The first pipe segment 134 is defined by a cylindrical pipe wall 102, an inner landing ring 136 that protrudes radially inward from the pipe wall 102, and an outer abutment ring 152 that protrudes radially outward from the pipe wall 102. The outer abutment ring 152 can be landed on a surrounding pipe of the second wellhead assembly 200, as will be discussed in more detail below. The first pipe segment 134 and the outer pipe 113 of the pipe assembly 101 together define an intermediately located annular region 138 (for example, an annulus). The sealing device 118 is designed to seal off the annular region 138 at an upper end 140 to contain any fluid pressure built up within the annular region 138 and thereby prevent any fluid within the annular region 138 from leaking to the atmosphere. In some embodiments, the pipe wall 102 has a length of up to about 65 in (for example, about 1.65 m) and a thickness that falls in a range of about 2.0 cm to about 1.8 cm.

The housing 108 is further equipped with a valve 142 (for example, a gate valve) by which fluid pressure can be relieved from the annular region 138 through an outlet 144. The outer pipe 113 of the pipe assembly 101 can be further installed to the first wellhead assembly 100 by landing the outer abutment ring 117 of the outer pipe 113 onto the inner landing ring 136 of the first pipe segment 134. The first pipe segment 134 is strong enough to bear a load of the outer pipe 113 and any components supported thereon without failing throughout drilling operations carried out at the wellbore 105.

The housing 108 is also equipped with a test port 146 by which a fluid (for example, nitrogen gas) can be injected to test the integrity of a welded connection between the first pipe segment 134 and the lower recessed profile 114 of the housing 108. Near an upper end, the housing 108 defines an exterior, circumferential quick connect profile 150 by which additional equipment can be installed to the first wellhead assembly 100 for facilitating well control (for example, containment of fluid pressure within the wellbore 105 during drilling operations). For example, a diverter system may be installed to the quick connect profile 150 to allow drilling fluid that was used to drill the wellbore 105 or any other formation fluid to be diverted away from the drilling plate form without compromising the well integrity or safety.

The second wellhead assembly 200 is a casing hanger that supports the first wellhead assembly 100 and defines an axial bore 260 that surrounds the first pipe segment 134. The second wellhead assembly 200 includes a generally cylindrical base plate 206 that is positioned beneath the housing 108 of the first wellhead assembly 100 and a generally cylindrical housing 208 that is located beneath the base plate 206. An inner diameter of the base plate 206 is about equal to the inner diameter of the lower recessed profile 114 of the housing 108 such that the first pipe segment 134 passes through the base plate 206.

Figure 3:
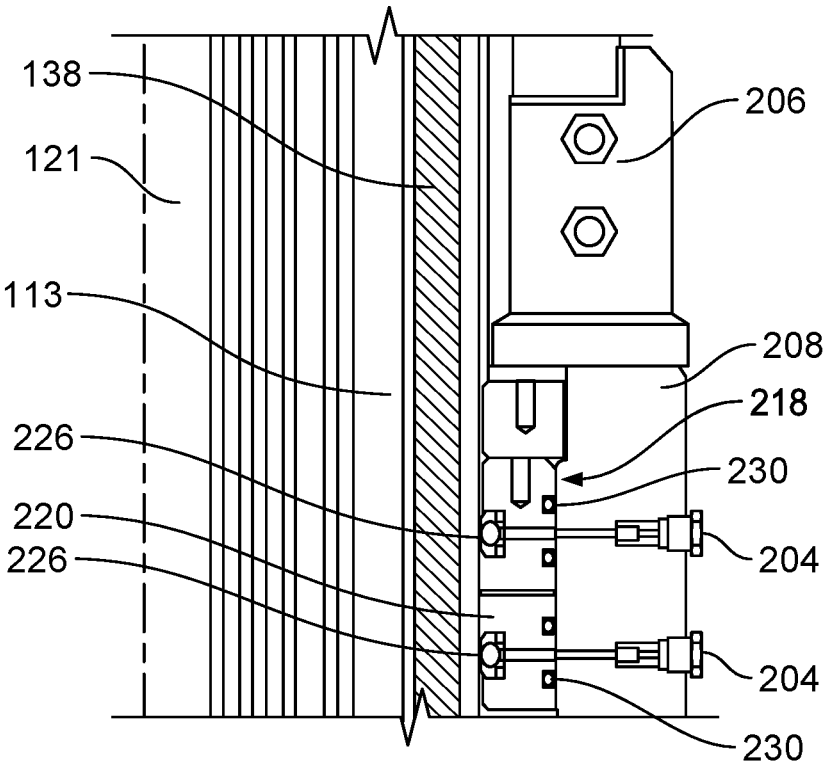
FIG. 3 is an enlarged cross-sectional view of a second set of sealing devices of the wellhead system of FIG. 1.

Referring to FIGS. 1 and 3, the housing 208 defines an upper recessed profile 212 (for example, an inner circumferential seat) and a lower recessed profile 214 (for example, an inner inverted circumferential seat). The housing 208 is equipped with an elastomeric, circumferential sealing device 218 (for example, a packoff) that is seated against the upper recessed profile 212 and a lock ring 216 that secures (for example, locks) the sealing device 218 in place against the upper recessed profile 212. The sealing device 218 and the lock ring 216 have an inner diameter that is about equal to the inner diameter of the base plate 206, thereby allowing passage of and contact with the first pipe segment 134 of the first wellhead assembly 100. The sealing device 218 includes two inner interference fit sealing elements 226 that seal against the first pipe segment 134, multiple outer interference fit sealing elements 230 that seal against the upper recessed profile 212 of the housing 208, a seal body 220 the supports the sealing elements 226, a test fitting 222 for testing a performance of the sealing device 218, and two injection ports 204. In the event that the sealing device 218 begins to perform poorly, the sealing device 218 can be re-energized to improve the sealing performance by injecting plastic into the injection ports 204.

Sizes and material formulations of the components of the sealing device 218 are selected such that the first pipe segment 134 of the first wellhead assembly 100 can move axially along the second wellhead assembly 200 when thermal expansion of the first pipe segment 134 causes such movement without loss of sealing integrity of the sealing device 218. The first pipe segment 134 has a precisely machined surface and is made of high grade materials for resisting corrosion during the equipment lifecycle. The interference fit sealing elements 226 are made of one or more materials that can provide the required sealing performance and that can withstand frictional forces exerted by the first pipe segment 134 during axial movement (for example, upward and downward movement) of the first pipe segment 134 due to thermal expansion. The interference fit sealing elements 226 are typically made of one or materials, such as rubber (for example, HNBR). The outer interference fit sealing elements 230 and the seal body 220 are typically made of one or materials, such as LAS.

The second wellhead assembly 200 also includes a second pipe segment 234 that is securely mated (for example, welded) to the lower recessed profile 214. The second size of the second wellhead assembly 200 is defined by an outer diameter of the second pipe segment 234. Accordingly, an inner diameter of the recessed profile 214 is sized to securely and snuggly accommodate the outer diameter of the second pipe segment 234. In some embodiments, the second size is about 36 in (for example, about 0.91 m).

The second pipe segment 234 is defined by a cylindrical pipe wall 202 and an inner landing ring 236 that protrudes radially inward from the pipe wall 202. The second pipe segment 234 and the first pipe segment 134 together define an intermediately located annular region 238 (for example, an annulus). The sealing device 218 is designed to seal off the annular region 238 at an upper end 240 to contain any fluid pressure built up within the annular region 238 and thereby prevent any fluid within the annular region 238 from leaking to the atmosphere. In some embodiments, the pipe wall 202 has a length of up to about 25 in (for example, about 0.635 m) and a thickness that falls in a range of about 1.2 cm to about 1.9 cm.

The housing 208 is further equipped with a valve 242 (for example, a gate valve) by which fluid pressure can be relieved from the annular region 236 through an outlet 244. The first pipe segment 134 of the first wellhead assembly 100 can be further installed to the second wellhead assembly 200 by landing the outer abutment ring 152 of the first pipe segment 134 onto the inner landing ring 236 of the second pipe segment 234. The second pipe segment 234 is strong enough to bear a load of the first pipe segment 134 and any components supported thereon without failing throughout drilling operations carried out at the wellbore 105.

The housing 208 is also equipped with a test port 246 by which a fluid (for example, nitrogen gas) can be injected to test the integrity of a welded connection between the pipe second pipe segment 234 and the lower recessed profile 214 of the housing. Near an upper end, the housing 208 defines an exterior, circumferential quick connect profile 250 by which additional equipment can be installed to the second wellhead assembly 200 for facilitating well control. For example, a diverter system may be installed to the quick connect profile 250 to allow drilling fluid that was used to drill the wellbore 105 or any other formation fluid to be diverted away from the drilling plate form without compromising the well integrity or safety.

The wellhead system 1000 provides several advantages with respect to conventional wellheads. For example, the wellhead system 1000 facilitates efficient equipment installation at a surface formation in that the second pipe segment 234 is pre-welded or otherwise preassembled with the housing 208 of the second wellhead assembly 200 at a shop location that is remote from the field. In contrast, like components of conventional wellheads must be installed to each other at the field, which is associated with relatively higher costs, more installation steps, and accordingly longer operational times. Furthermore, the wellhead system 1000 advantageously provides both sealing integrity and accommodation for thermal growth of interior pipes, which is not provided by conventional wellhead designs.

Figure 4:
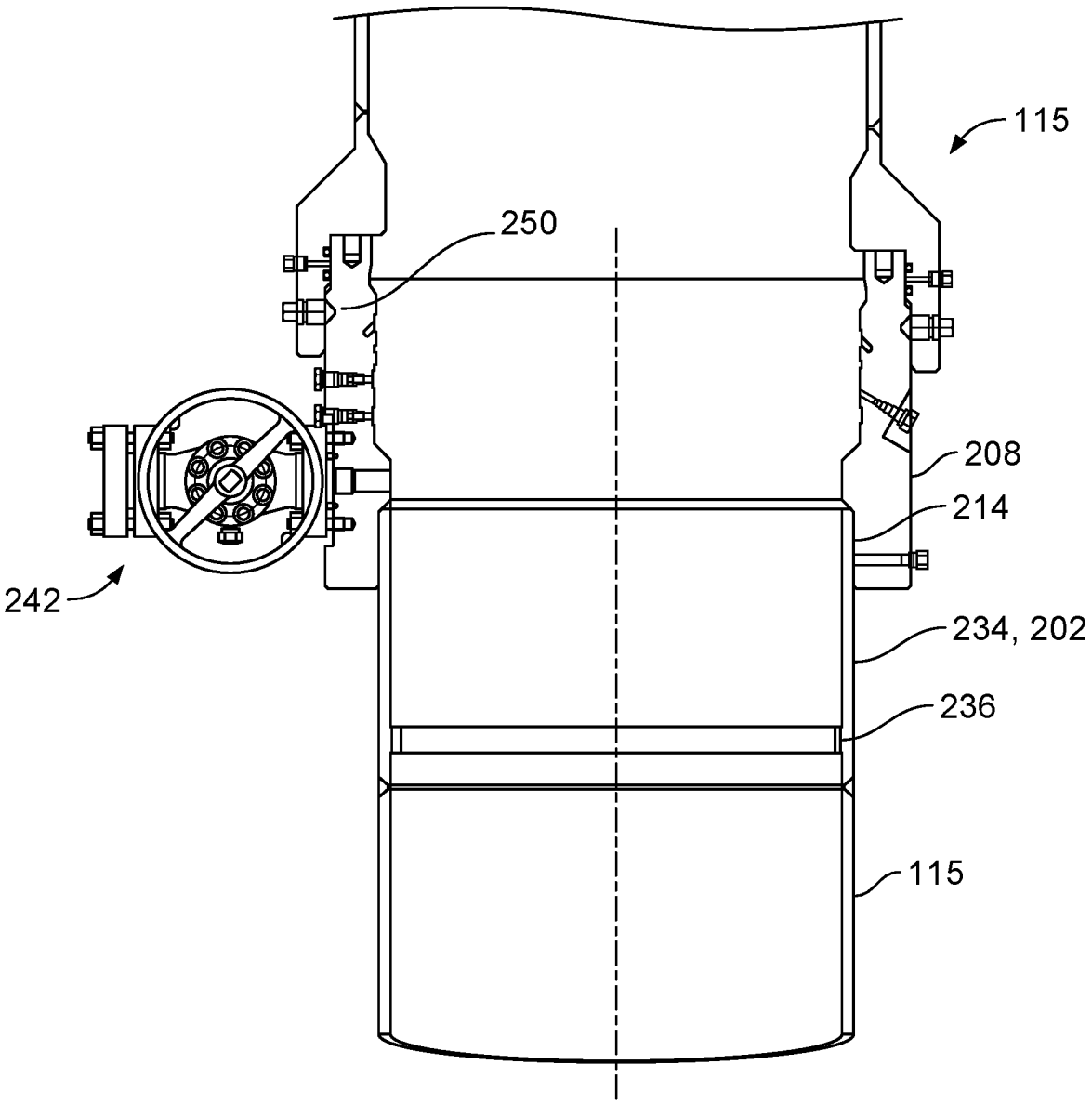
FIGS. 4-8 sequentially illustrate a method of installing the wellhead system of FIG. 1 at a pipe assembly within a surface formation.

In use at the surface formation 103, the wellhead system 1000 is installed to the pipe assembly 101 sequentially in stages to carry out multiple operations at the wellbore 105. Referring to FIG. 4, the housing 208 of the wellhead assembly 200, equipped with the second pipe segment 234 and the valve 242, is transported to a location of the pipe assembly 101 and welded at the inner landing ring 236 to a pipe segment 115 (for example, a casing stub) of the second size that surrounds the first pipe segment 134 (not shown). A riser adapter (not shown) is built upwards section-by-section (for example, nippled up) and mated to the exterior quick connect profile 250 to establish a connection between the housing 208 and a diverter 115. The connection will provide a continuous containment of fluid within the pipe assembly 101 until the fluid reaches the diverter 115. A drilling operation is then performed at the pipe assembly 101.

Figure 5:
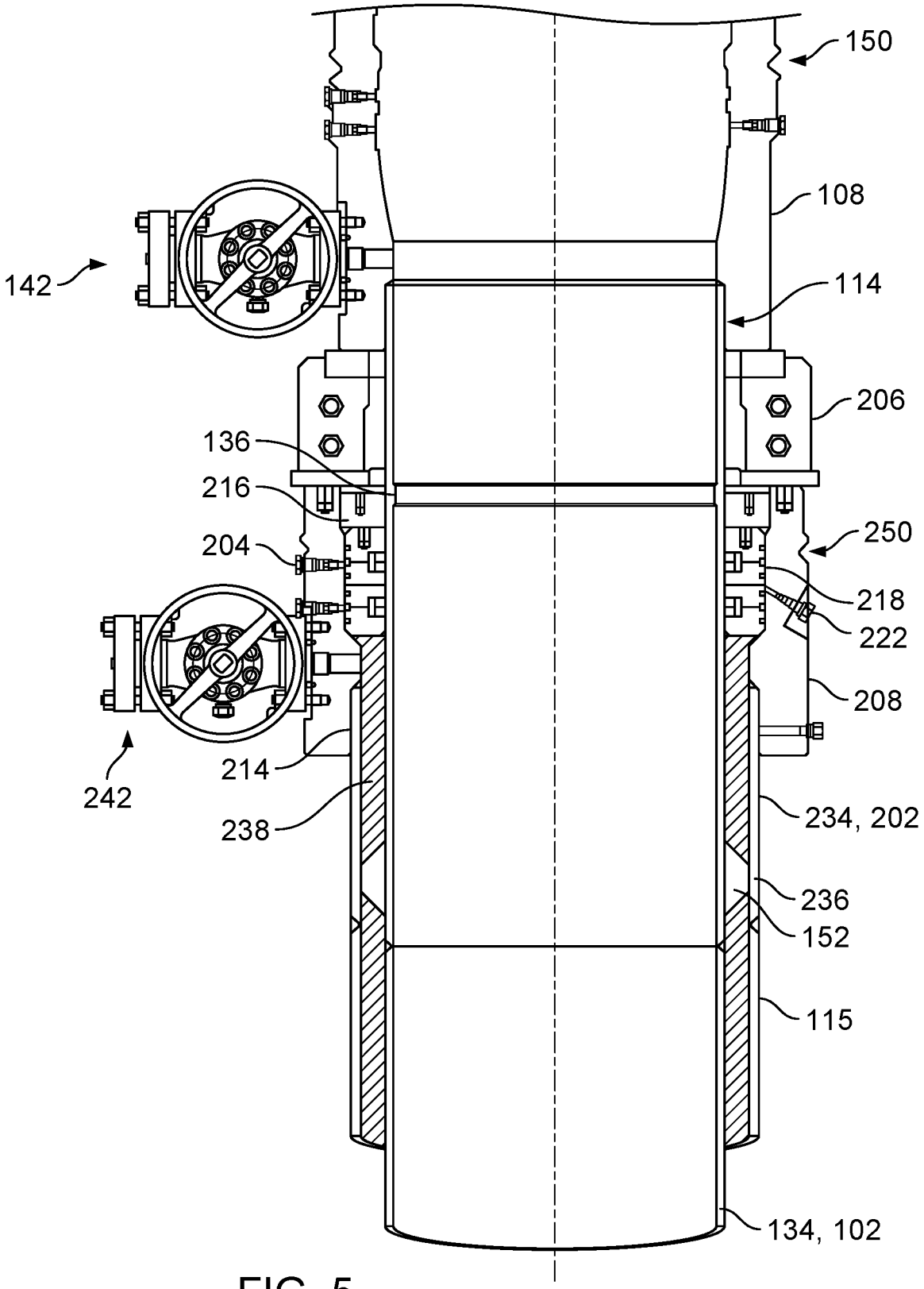

Referring to FIG. 5, once the drilling operation is completed, the first pipe segment 134 is installed to the second pipe segment 234 by landing the outer abutment ring 152 of the first pipe segment 134 onto the inner landing ring 236 of the second pipe segment 234 and cementing the annular region 238 above the rings 152, 236. The connection between the riser adapter and the quick connect profile 250 is broken, and the first pipe segment 134 is cut to a height appropriate for subsequent installation of the base plate 206 and the housing 108 of the first wellhead assembly 100. Next, the sealing device 218 is installed to the housing 208 with the lock ring 216 and tested via the test port 222. If the testing is unsuccessful, then one or more components of the wellhead assembly 200 may be further examined before proceeding with further steps. Otherwise, successful test results indicate that the annular region 238 is fluidically isolated by the sealing device 218. The base plate 206 is installed to the housing 208, and the housing 108 of the first wellhead assembly 100 is subsequently installed to the first pipe segment 134 extending through the wellhead assembly 200 atop the base plate 206.

Figure 6:
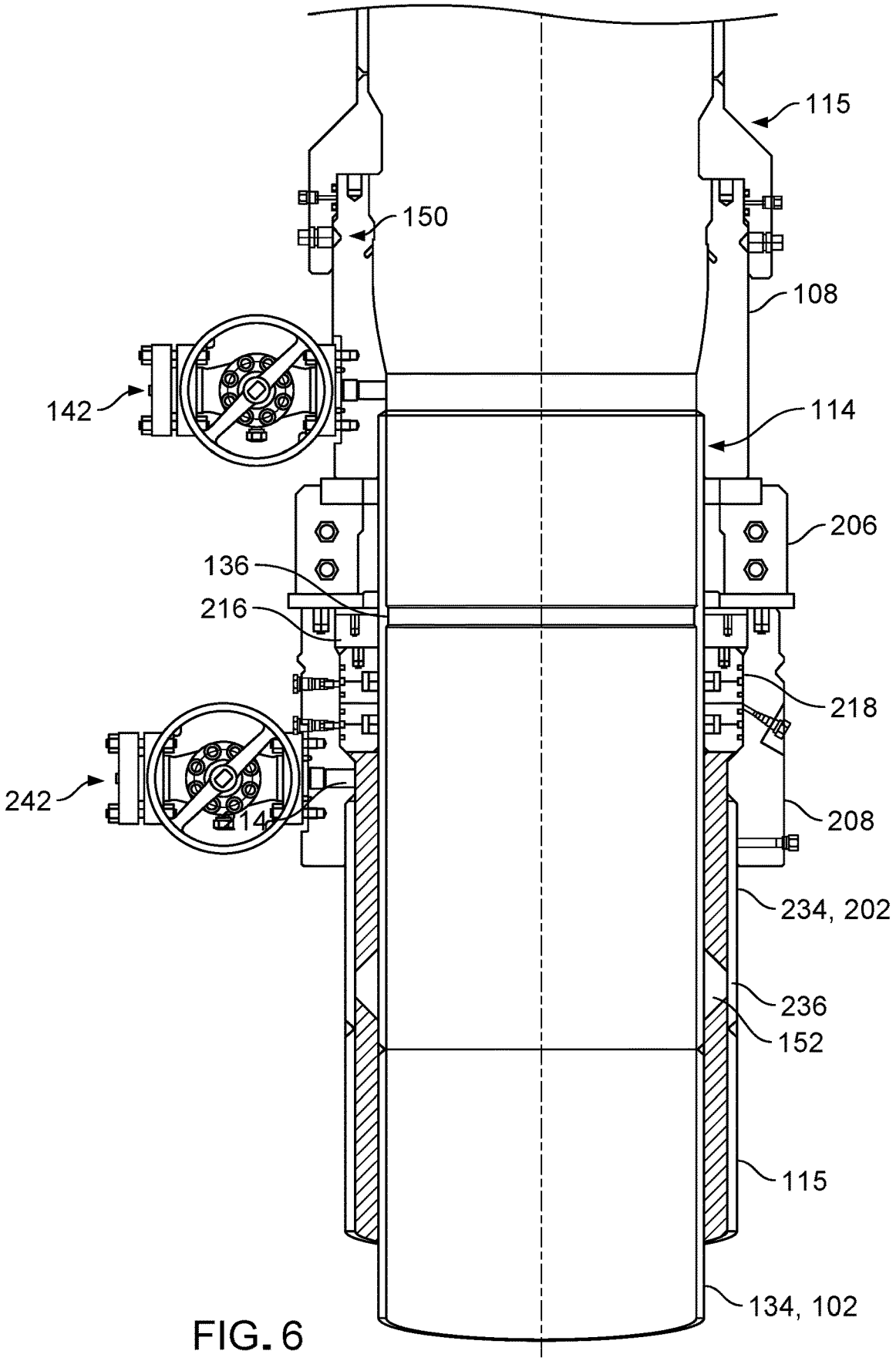

Referring to FIG. 6, the riser adapter is built upwards section-by-section and mated to the exterior quick connect profile 150 to establish a connection between the housing 108 and the diverter 115 A drilling operation is then performed at the pipe assembly 101.

Figure 7:
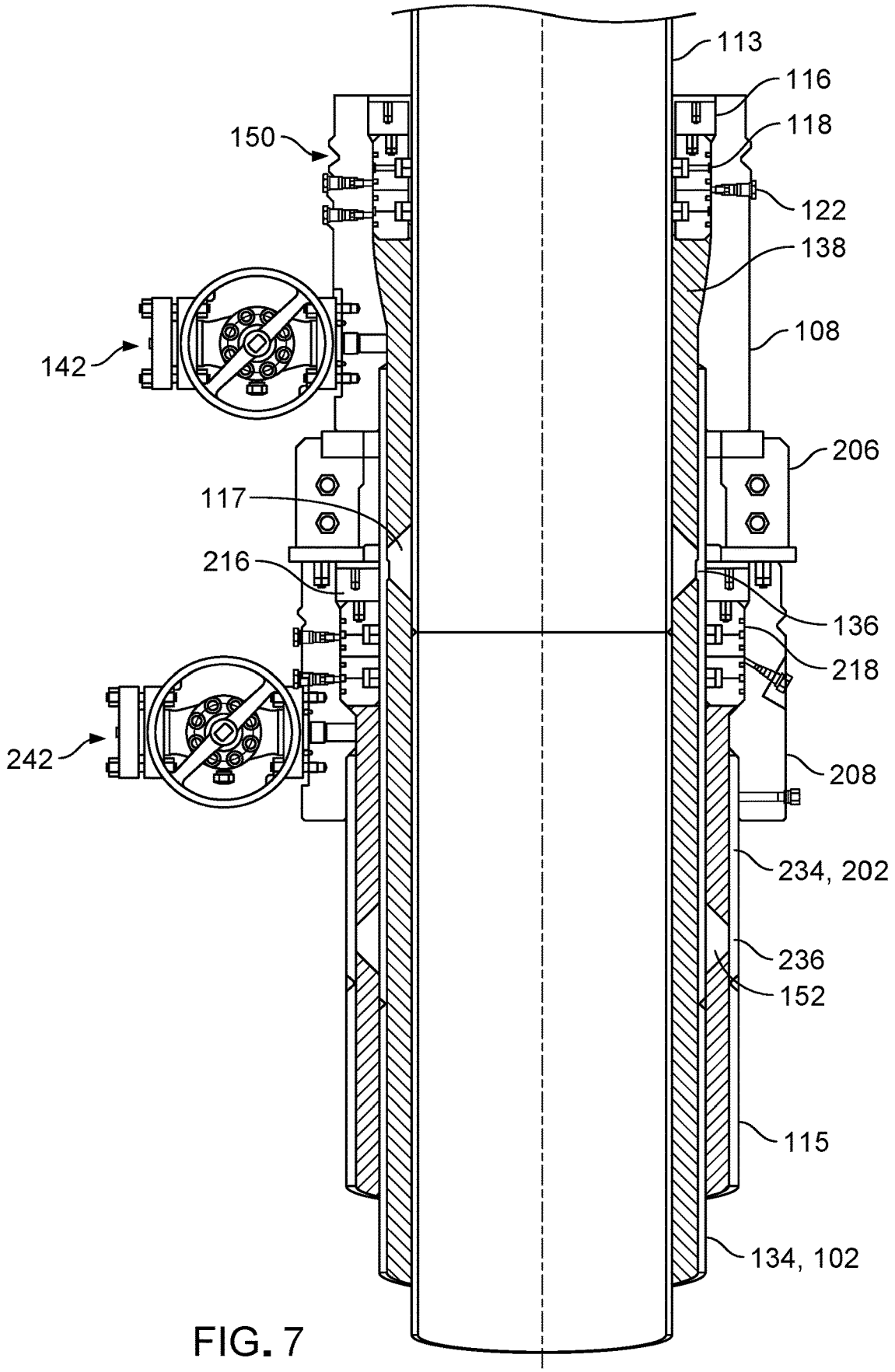

Referring to FIG. 7, once the drilling operation is completed, the outer pipe 113 of the pipe assembly 101 is installed to the first pipe segment 134 by landing the outer abutment ring 117 of the outer pipe 113 onto the inner landing ring 136 of the first pipe segment 134 and cementing the annular region 138 above the rings 117, 136. The connection between the riser adapter and the quick connect profile 150 is broken, and the outer pipe 113 is cut to a height appropriate for subsequent installation of the base plate 106 and the housing 109 of the reference wellhead assembly 107. Next, the sealing device 118 is installed to the housing 108 with the lock ring 116 and tested via the test port 122. If the testing is unsuccessful, then one or more components of the wellhead assembly 100 may be further examined before proceeding with further steps. Otherwise, successful test results indicate that the annular region 138 is fluidically isolated by the sealing device 118.

Figure 8:
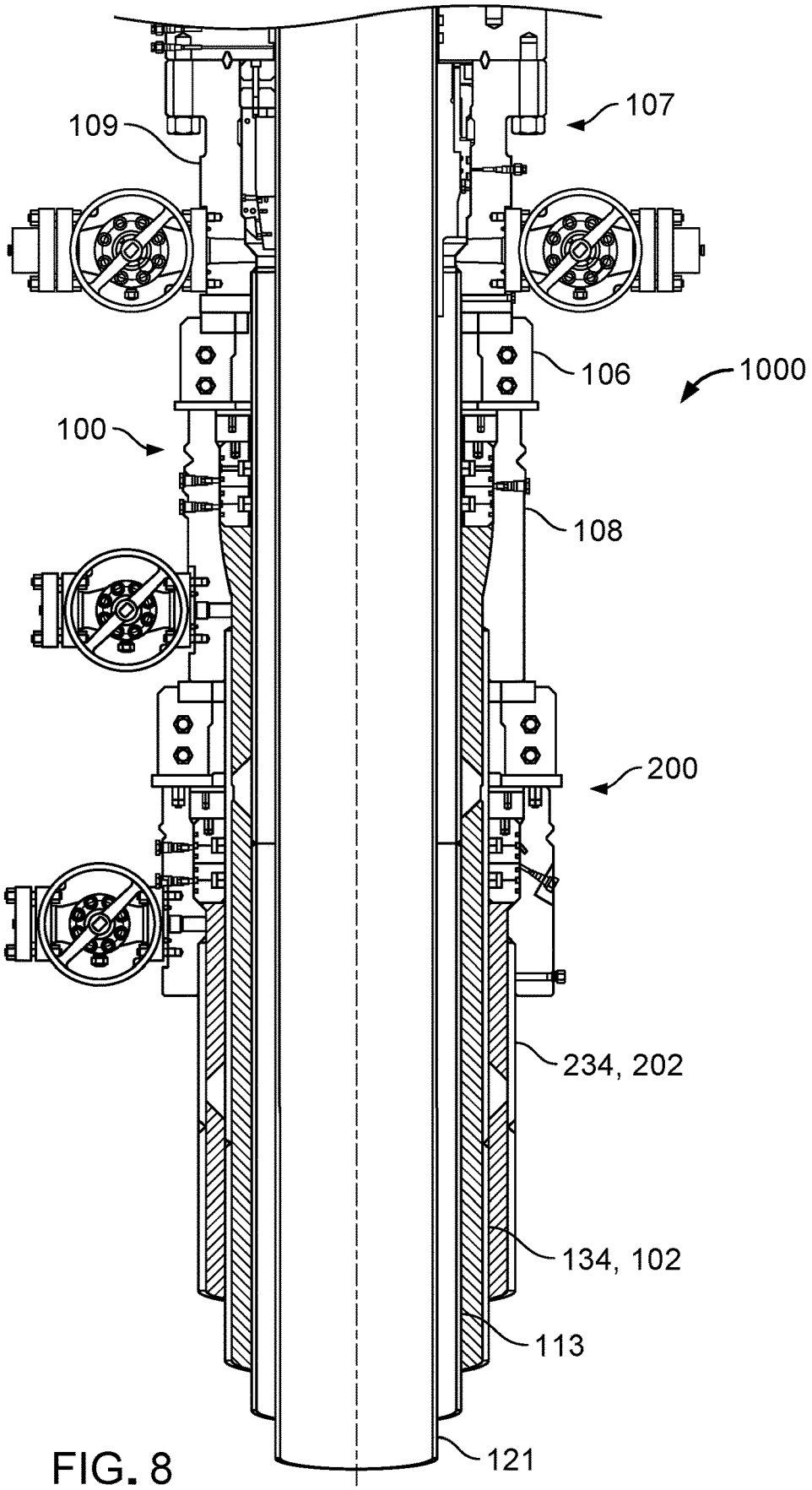

Referring to FIG. 8, the reference wellhead assembly 107 is installed to the outer pipe 113, and then the base plate 106 is installed on top of housing 108 and below the housing 109 of the reference wellhead assembly 107 to complete installation of the wellhead system 1000. Upon completion of the installation, the outer pipe 113 of the pipe assembly 101 extends through the wellhead assemblies 100, 200.

Figure 9:
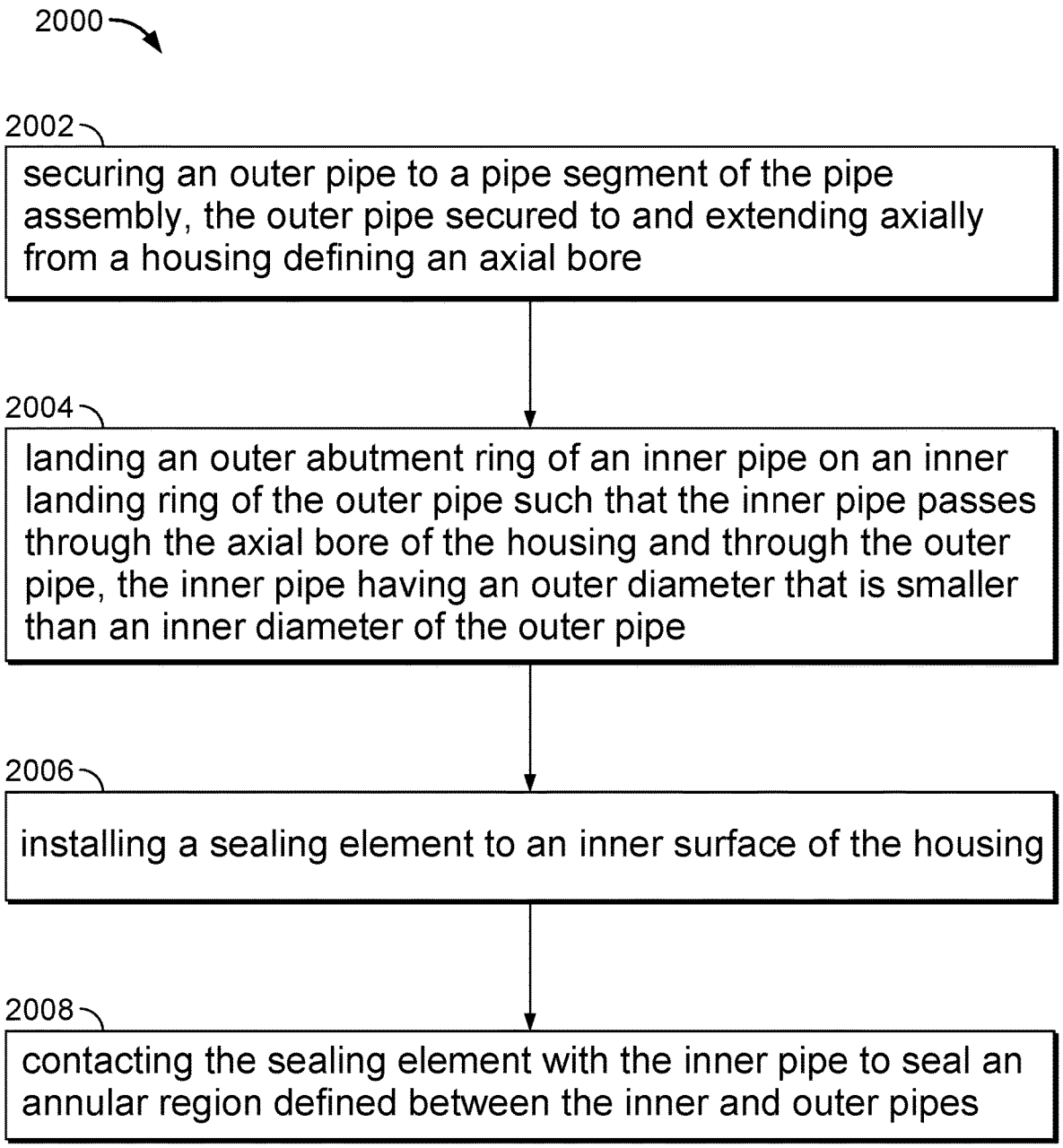
FIG. 9 is a flow chart illustrating an example method of installing the wellhead system of FIG. 1 at a pipe assembly.

FIG. 9 is a flow chart illustrating an example method 2000 of installing a wellhead system (for example, the wellhead system 1000) at a pipe assembly (for example, the pipe assembly 101). In some embodiments, the method 2000 includes a step 2002 of securing an outer pipe (for example, the second pipe segment 234) to a pipe segment of the pipe assembly, the outer pipe secured to and extending axially from a housing (for example, the housing 208) defining an axial bore (for example, the axial bore 260). In some embodiments, the method 2000 includes a step 2004 of landing an outer abutment ring (for example, an outer abutment ring 152) of an inner pipe (for example, the first pipe segment 134) on an inner landing ring (for example, the inner landing ring 236) of the outer pipe such that the inner pipe passes through the axial bore of the housing and through the outer pipe, the inner pipe having an outer diameter that is smaller than an inner diameter of the outer pipe. In some embodiments, the method 2000 includes a step 2006 of installing a sealing device (for example, a sealing device 218) to an inner surface of the housing. In some embodiments, the method 2000 includes a step 2008 of contacting the sealing device with the inner pipe to seal an annular region (for example, the annular region 238) defined between the inner and outer pipes.

While the wellhead system 1000 has been described and illustrated with respect to certain dimensions, sizes, shapes, arrangements, materials, and methods 2000, in some embodiments, a wellhead system that is otherwise substantially similar in construction and function to the wellhead system 1000 may include one or more different dimensions, sizes, shapes, arrangements, and materials or may be utilized according to different methods.

Accordingly, other embodiments are also within the scope of the following claims.

What is claimed is:

1. A wellhead system comprising:

a housing defining an axial bore and a quick connect profile for connection to a well-control device;

an outer pipe secured to the housing, extending axially from the housing, and comprising an outer pipe wall and a landing ring that protrudes radially inward from the outer pipe wall;

an inner pipe passing through the axial bore and through the outer pipe and having an outer diameter that is smaller than an inner diameter of the outer pipe; and a sealing device positioned along an inner surface of the housing and comprising:

a body seated within an inner recess of the housing above an annular region defined between the inner and outer pipes, wherein the body is radially aligned with the annular region and defines an upper end of the annular region such that the annular region terminates at the body, a rubber interference fit sealing element carried on an inner surface of the body and sealed to the inner pipe, and an outer interference fit sealing element carried on an outer surface of the body and sealed to the housing at the inner recess, wherein the sealing device is configured to accommodate axial movement of the inner pipe due to thermal expansion of the inner pipe while maintaining a seal integrity against the inner pipe at the rubber interference fit sealing element to seal the annular region at the body of the sealing device, the inner pipe, and the housing.

2. The wellhead system of claim 1, further comprising a lock ring that secures the sealing device to the inner recess of the housing.

3. The wellhead system of claim 1, wherein the sealing device comprises a test port for testing an integrity of the seal.

4. The wellhead system of claim 1, wherein the sealing device is configured to be reenergized following a reduction in sealing performance.

5. The wellhead system of claim 4, wherein the sealing device comprises an injection port for injecting a substance to reenergize the sealing device.

6. The wellhead system of claim 1, wherein the inner pipe comprises an inner pipe wall and an abutment ring that protrudes radially outward from the inner pipe wall.

7. The wellhead system of claim 6, wherein the inner pipe is configured such that the abutment ring can land on the landing ring, and the outer pipe is configured to support a load of the inner pipe.

8. The wellhead system of claim 6, wherein the landing ring is a first landing ring, and wherein the inner pipe comprises a second inner landing ring that protrudes radially inward from the inner pipe wall.

9. The wellhead system of claim 1, further comprising a base plate positioned atop the housing.

10. The wellhead system of claim 1, wherein the housing defines an exterior quick connect profile for attachment to an accessory component.

11. The wellhead system of claim 1, further comprising a valve carried on the housing for relieving a pressure within the annular region.

12. The wellhead system of claim 1, wherein the housing is a first housing, the sealing device is a first sealing device, and the inner pipe is a first inner pipe, the wellhead system further comprising:

a second housing positioned above the first housing and secured to the first inner pipe such that the first inner pipe extends axially from the second housing;

a second inner pipe passing through an axial bore of the second housing and through the first inner pipe and having an outer diameter that is smaller than an inner diameter of the first inner pipe; and a second sealing device positioned along an inner surface of the second housing and sealed to the second inner pipe to seal a second annular region defined between the first and second inner pipes.

13. The wellhead system of claim 12, wherein the second sealing device is configured to accommodate thermal expansion of the second inner pipe while maintaining a seal integrity against the second inner pipe.

14. The wellhead system of claim 12, wherein the lock ring is a first lock ring, the wellhead system further comprising a second lock ring that secures the second sealing device to the second housing.

15. The wellhead system of claim 1, wherein the body and the outer interference fit sealing element of the sealing device are made of metal.

16. A method of installing a wellhead system at a pipe assembly, the method comprising:

securing an outer pipe to a pipe segment of the pipe assembly, the outer pipe secured to and extending axially from a housing defining an axial bore and a quick connect profile for connection to a well-control device, and the outer pipe comprising an outer pipe wall and an inner landing ring that protrudes radially inward from the outer pipe wall;

landing an outer abutment ring of an inner pipe on the inner landing ring protruding from the outer pipe wall such that the inner pipe passes through the axial bore of the housing and through the outer pipe, the inner pipe having an outer diameter that is smaller than an inner diameter of the outer pipe;

installing a body of a sealing device to an inner recess of the housing;

contacting a rubber interference fit sealing element carried on the body of the sealing device with the inner pipe to seal an annular region defined between the inner and outer pipes, wherein the body of the sealing device is located above the annular region, is radially aligned with the annular region, and defines an upper end of the annular region such that the annular region terminates at the body;

contacting an outer interference fit sealing element carried on an outer surface of the body with the housing at the inner recess to seal the body to the housing; and maintaining a seal integrity of the sealing device against the inner pipe at the rubber interference fit sealing element to maintain sealing of the annular region at the body of the sealing device, at the inner pipe, and at the housing while the inner pipe moves axially due to thermal expansion.

* * * * *